US009396711B2

(12) United States Patent
John et al.

(10) Patent No.: US 9,396,711 B2
(45) Date of Patent: Jul. 19, 2016

(54) MUSICAL INSTRUMENT VALVE SYSTEM

(71) Applicants: David John, Mesa, AZ (US); John Eth, Mesa, AZ (US)

(72) Inventors: David John, Mesa, AZ (US); John Eth, Mesa, AZ (US)

( * ) Notice: Subject to any disclaimer, the term of this patent is extended or adjusted under 35 U.S.C. 154(b) by 0 days.

(21) Appl. No.: 14/861,123

(22) Filed: Sep. 22, 2015

(65) Prior Publication Data

US 2016/0086587 A1 Mar. 24, 2016

Related U.S. Application Data

(60) Provisional application No. 62/053,478, filed on Sep. 22, 2014.

(51) Int. Cl.
*G10D 9/04* (2006.01)

(52) U.S. Cl.
CPC ..... *G10D 9/04* (2013.01)

(58) Field of Classification Search
CPC ..... G10D 9/04
See application file for complete search history.

(56) References Cited

U.S. PATENT DOCUMENTS 1,596,655 A * 8/1926 Hall ..... G10D 9/04 84/392
2,008,900 A * 7/1935 Dewey ..... G10D 9/04 84/392
2,132,329 A * 10/1938 Todt ..... G10D 9/04 84/388
2,259,756 A * 10/1941 Lindsay ..... F16K 11/065 137/625.29
2,320,202 A * 5/1943 Thompson ..... G10D 7/10 84/388
2,438,231 A * 3/1948 Schultz ..... B43K 23/126 211/DIG. 1
2,612,811 A * 10/1952 Meyers ..... G10D 9/04 84/392
2,794,358 A * 6/1957 Albert ..... G10D 9/04 84/388
2,798,401 A * 7/1957 Miller ..... G10D 9/04 84/392
2,929,292 A * 3/1960 Greenleaf ..... G10D 9/04 84/388
2,988,948 A * 6/1961 Eash ..... G10D 9/04 267/134
3,030,846 A * 4/1962 Greenleaf ..... G10D 9/04 84/388
3,044,339 A * 7/1962 Greenleaf ..... G10D 9/04 84/392
3,494,242 A * 2/1970 Kurokawa ..... G10D 9/04 84/389
3,671,011 A * 6/1972 Oguma ..... G10D 9/04 137/625.29
3,835,748 A * 9/1974 Olson ..... G10D 9/04 84/388
3,990,342 A * 11/1976 Reeves ..... G10D 9/04 84/392
4,210,056 A * 7/1980 Ciccarelli ..... G10D 9/04 84/392
6,008,444 A * 12/1999 Chesko ..... G10D 9/04 84/388
6,382,450 B1 * 5/2002 De Rosa ..... B65D 41/02 206/818
7,770,601 B2 * 8/2010 Perry ..... B60C 29/06 137/232

* cited by examiner

*Primary Examiner* — Robert W Horn
(74) *Attorney, Agent, or Firm* — Schmeiser, Olsen & Watts LLP

(57) ABSTRACT

A musical instrument valve system is provided. The system includes a valve case having a main body, a top member and a bottom member. The main body includes at least one chamber. The top member includes at least one chamber corresponding to the inner chamber of the main body, the top member removably coupled to a top side of the main body. The bottom member includes a chamber corresponding to the chamber of the main body, the bottom member removably coupled to a bottom side of the main body. The system includes more than one valve operatively coupled to the top member and corresponding to the more than one chambers of the main body. The more than one valve is removed from the main body when removing the top member. The system also includes a quick release valve cap coupled to an existing valve casing of the musical instrument.

20 Claims, 12 Drawing Sheets

MUSICAL INSTRUMENT VALVE SYSTEM

CROSS-REFERENCE TO RELATED APPLICATION

This application claims benefit of U.S. Provisional Patent Application No. 62/053,478 to John et al. entitled "MUSICAL INSTRUMENT VALVE SYSTEM,", filed Sep. 22, 2014, which application is incorporated herein by reference.

BACKGROUND OF THE INVENTION

1. Technical Field

This invention relates generally to valves of a musical instrument and more particularly to a valve case of a musical instrument.

2. State of the Art

There are various types of brass-wind instruments that also utilize valves in order to change the pitch of the notes being played. Some of these instruments include, for example, trumpets, baritones, tubas and the like. Generally, depressing and releasing one or more of the piston valves of the instrument changes the length of the tubing, resulting in either lowering or raising the pitch. Conventional brass-wind valve instruments have individual valves that require maintenance and such maintenance occurs by unscrewing each individual valve and providing the maintenance. This is burdensome, particularly if maintenance is needed during a performance, such as needing to add oil to the valves.

In order to access the valve, a valve cap needs to be unthreaded from the valve casing, the valve removed, and maintenance performed. Then the valve cap needs to be threaded again onto the valve casing. Often times, when a user is in a hurry, the valve cap become cross threaded and causes damage to the musical instrument. Further, the valves have apertures extending through them that fluidly engage ports in the manifold portion the valves are retained within. Because the valves engage ports, it is critical that the valve is aligned and requires additional care and time to ensure. The time necessary to perform the maintenance on valves of an instrument is time consuming and difficult.

Accordingly, there is a need in the field of musical instruments for an improved valve system.

SUMMARY OF EMBODIMENTS OF THE INVENTION

The present invention relates to a valve system for use in a musical instrument, wherein the valve system comprises a valve case having inner chambers for receiving a valve, wherein the valve case includes a main body, a removable top member and a removably bottom member, the removably top and bottom members operating to provide access to the inner chambers of the valve case.

According to an embodiments, the present invention includes a musical instrument valve system comprising a main body comprising more than one inner chamber and ports; a top member comprising more than one chamber corresponding to the more than one chamber of the main body, wherein the top member is removably coupled to a top side of the main body; a bottom member comprising more than one chamber corresponding to the more than one chamber of the main body, wherein the bottom member is removably coupled to a bottom side of the main body; and more than one valve operatively coupled to the top member, the more than one valve corresponding to the more than one chambers of the main body, wherein the more than one valve is removed from the main body in response to removing the top member. In embodiments, the top member comprises magnets and the main body comprises magnets, wherein the top member is removably coupled to the main body by magnetic forces.

According to an embodiments, the present invention includes a musical instrument valve system comprising a main body comprising an inner chamber and port; a top member comprising a chamber corresponding to the inner chamber of the main body, wherein the top member is removably coupled to a top side of the main body; a bottom member comprising a chamber corresponding to the inner chamber of the main body, wherein the bottom member is removably coupled to a bottom side of the main body; and a valve operatively coupled to the top member, the valve corresponding to the chamber of the main body, wherein the valve is removed from the main body in response to removing the top member. In embodiments, the top member comprises magnets and the main body comprises magnets, wherein the top member is removably coupled to the main body by magnetic forces.

An embodiment includes a musical instrument valve cap system comprising: a valve cap comprising an aperture for a stem of a valve to extend there through and a recess for receiving a valve casing within the recess; and an attachment device for releasably coupling the valve cap to a valve casing, wherein the attachment device comprises: a first coupling member coupled within the recess of the valve cap; and a second coupling member coupled to a top end of the valve casing, wherein the first coupling member is releasably coupled to the second coupling member without threads.

Another embodiment includes a method of using a musical instrument valve cap system. The method comprises playing a musical instrument having a valve cap comprising an aperture for a stem of a valve to extend there through and a recess for receiving a valve casing within the recess; determining a need to service the valve of the musical instrument; disengaging an attachment device of the valve cap system to remove the valve cap from the valve casing, wherein the attachment device comprises: a first coupling member coupled to the valve cap; and a second coupling member coupled to a top end of the valve casing, wherein the first coupling member is releasably coupled to the second coupling member without threads; servicing the valve; and engaging the first coupling member with the second coupling member of the attachment device of the valve cap system.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a valve system for use in a musical instrument, wherein the valve system comprises a valve case having inner chambers for receiving a valve, wherein the valve case includes a main body, a removable top member and a removably bottom member, the removably top and bottom members operating to provide access to the inner chambers of the valve case.

Figure 1:
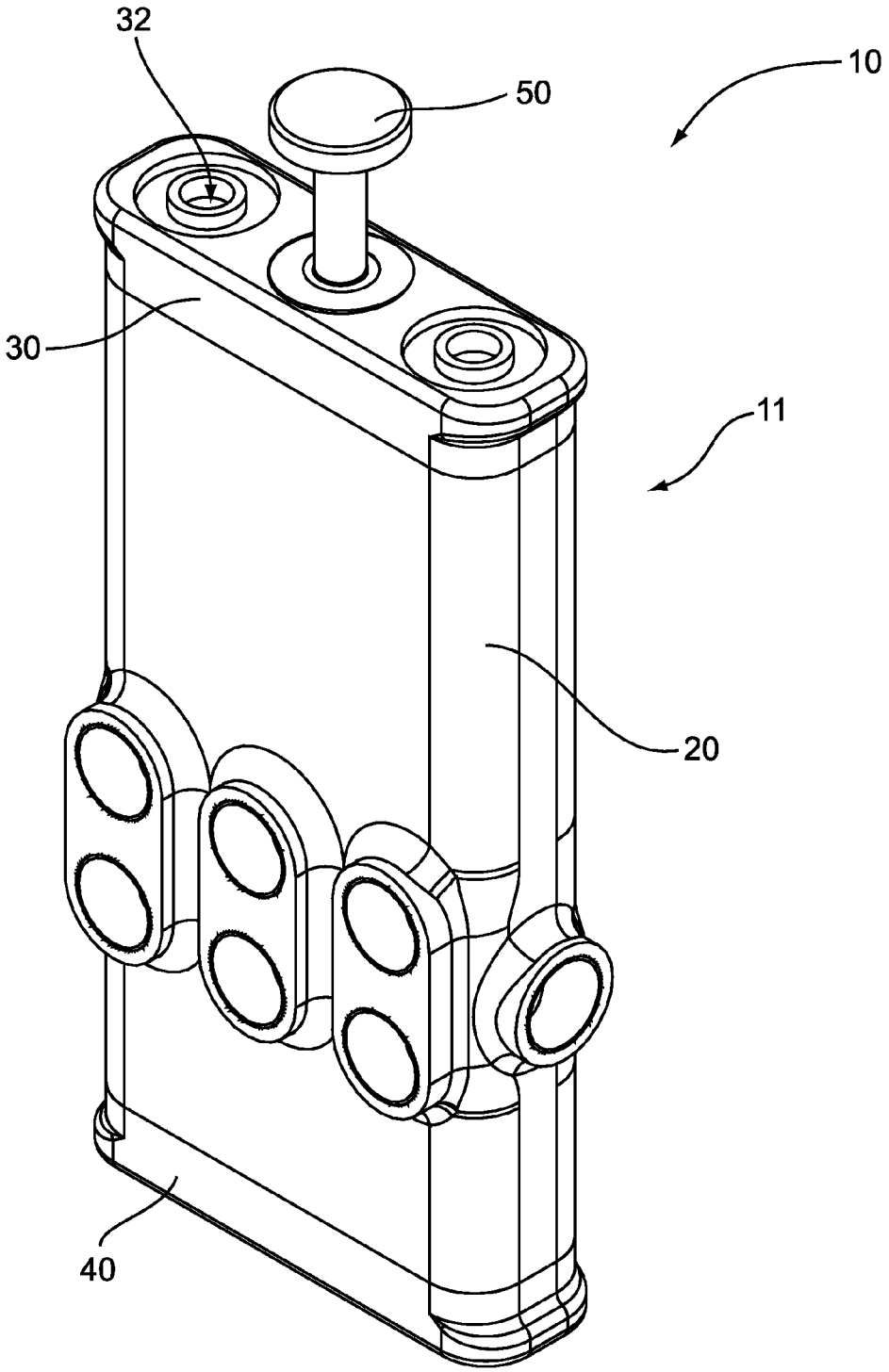
FIG. 1 is a perspective view of a valve system for a musical instrument.

Referring to the drawings, FIG. 1 depicts and embodiment of a valve system 10 for use with a musical instrument. The valve system 10 comprises a valve case 11 and a valve 50. The valve case 11 comprises a main body 20, a top member 30 and a bottom member 40, wherein the top member 30 and the bottom member 40 are repeatably, removably coupled to the main body 20.

Figure 5:
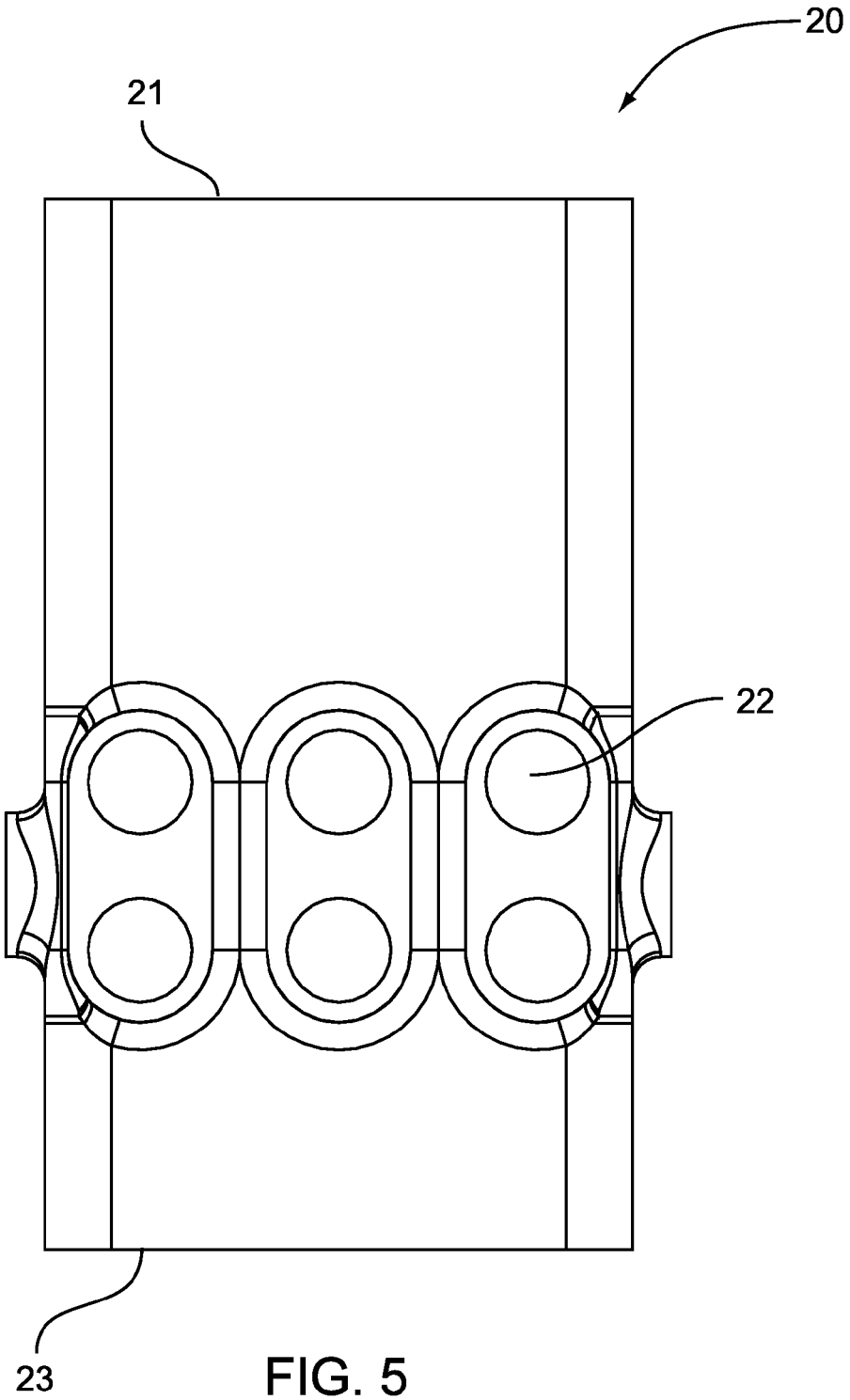
FIG. 5 is a side view of a main body of a valve case.
Figure 6:
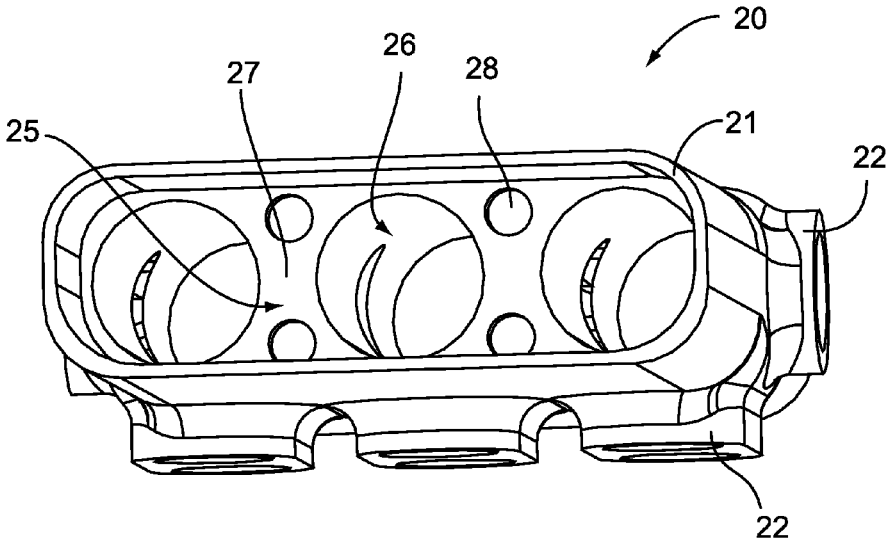
FIG. 6 is a top view of a main body of a valve case.
Figure 7:
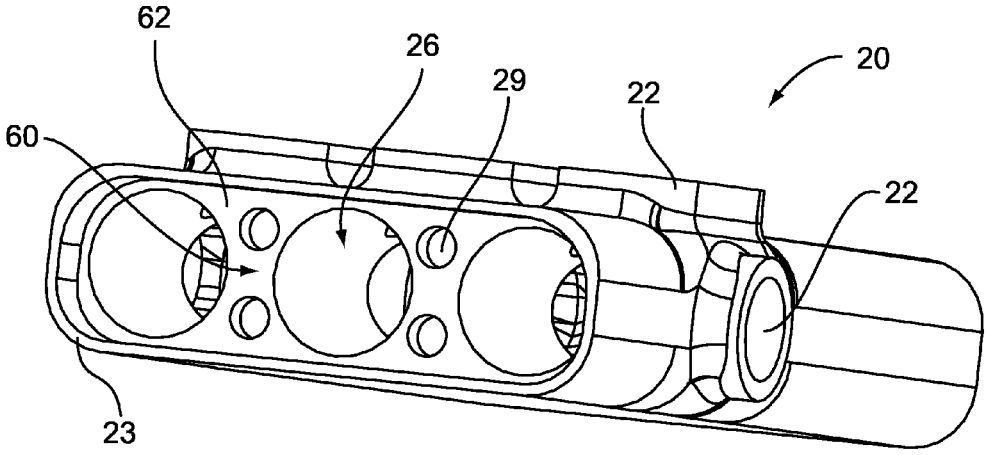
FIG. 7 is a bottom view of a main body of a valve case.

Referring to FIGS. 5-7, embodiments of the main body 20 may be a unitary body that comprises a top side 21, a bottom side 23 and ports 22. The main body 20 may further include one or more inner chambers 26 for slidingly receiving the valves 50. The main body 20 further comprises a recess 25 extending from the top side 21 to form top inner surface 27. The top recess 25 is sized and shaped to receive a lower portion 31 of the top member 30 (see FIG. 2). In some embodiments, magnets 28 may be coupled to top inner surface 27. The main body 20 further comprises a recess 60 extending from the bottom side 23 to form bottom inner surface 62. In some embodiments, magnets 29 may be coupled to bottom inner surface 62. The bottom recess 60 is sized and shaped to receive an upper portion 41 of the bottom member 40 (see FIG. 8).

Figure 2:
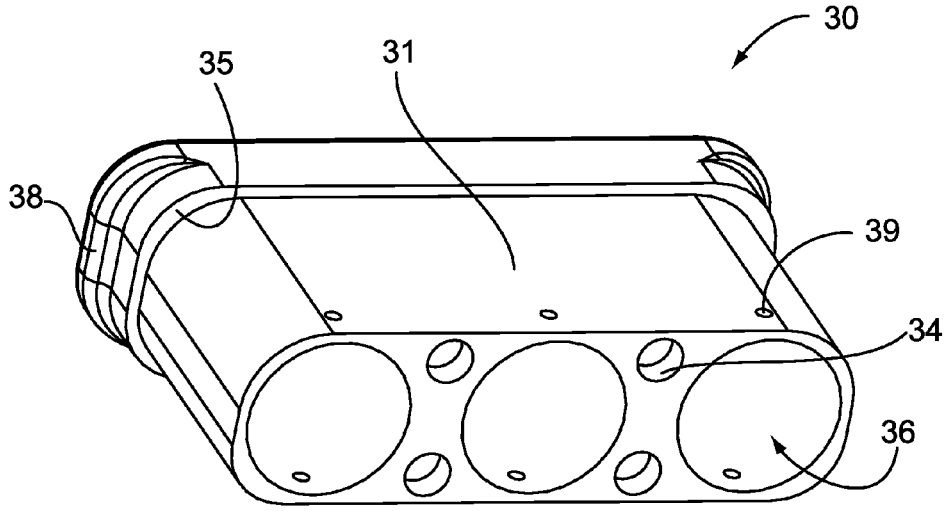
FIG. 2 is a perspective view of a top member of a valve case.
Figure 3:
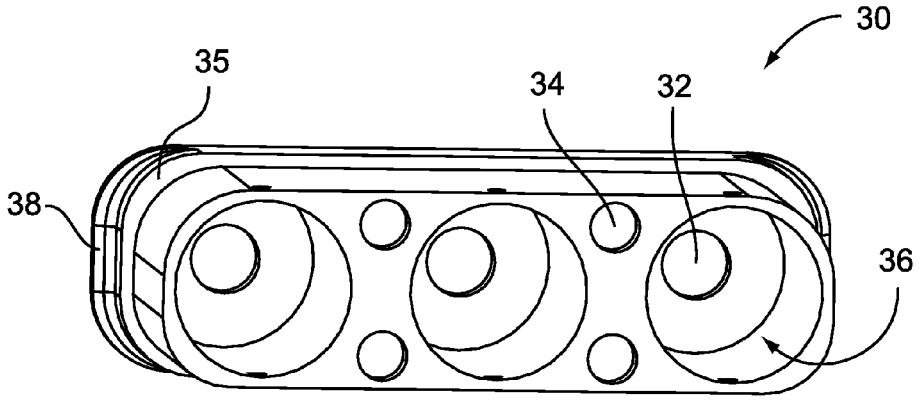
FIG. 3 is a bottom perspective view of a top member of a valve case.
Figure 4:
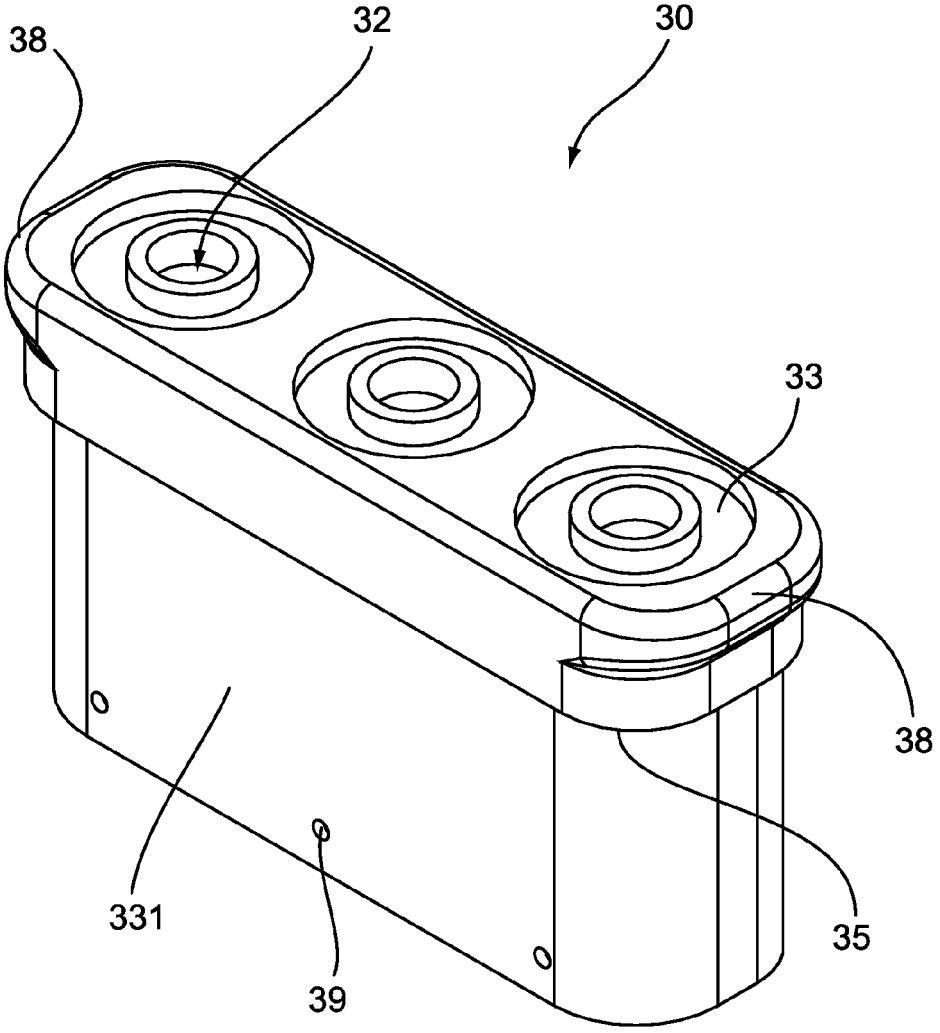
FIG. 4 is another perspective view of a top member of a valve case.

Referring further to the drawings, FIGS. 2-4 depict an embodiment of a top member 30 of a valve case 11. The top member 30 may be a unitary body that comprises lower portion 31 with one or more chambers 36. The number of chambers 36 corresponds to the number of valves for the musical instrument. For example, as shown, the number of chambers is three; however, it may be four or any other number of chambers. Further, the number of chambers 36 of the top member 30 also corresponds to the number of chambers 26 of the main body 20 (see FIG. 6). The top member may also include apertures 32 that extend through a top side of the top member 30. Each aperture 32 engages a chamber 36 and allows for proper installation and operation of a valve 50.

The top member 30 further includes magnets 34 coupled on a bottom surface of the lower portion 31 of the top member 30. The magnets 34 operate to couple the top member 30 to the main body 20. This occurs by magnets 34 engaging magnets 28 of top inner surface 27 of the main body 20, wherein the top inner surface 27 is formed from recess 25 (see FIG. 6). The top member 30 also includes a ridge surface 35, wherein the ridge surface 35 operates to engage a top side 21 of the main body 20 (see FIG. 5). The top member 30 further includes protrusions 38 extending from opposing sides of the top member 30. The protrusions 38 provide a gripping surface for a user to grasp when removing the top member 30 from the main body 20.

Figure 11:
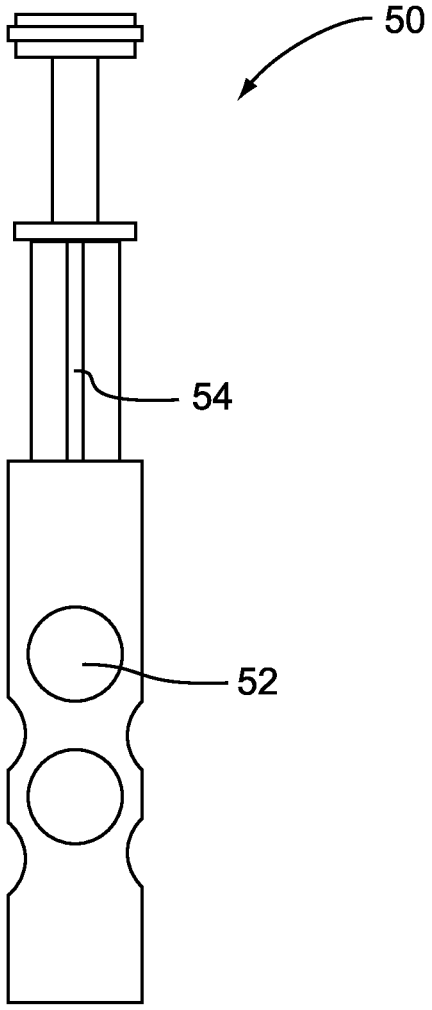
FIG. 11 is a side view of a valve of a valve system.

The top member 30 may further include an aperture 39 extending transversely through each chamber 36. Each aperture 39 is sized and shaped to receive a retaining rod there through. The retaining rod operates to engage slot 54 of valve 50 (see FIG. 11). Slot 54 allows the valve 50 to have a full range of motion, while maintaining proper alignment within chamber 36 to properly align the valve openings 52 (see FIG. 11) with ports 22 of the main body (see FIG. 5).

Further, the lower portion 31 of the top member 30 may have as asymmetric perimeter. The asymmetric perimeter of the lower portion corresponds to an asymmetric recess 25 extend from a top surface 21 of the main body 20 (see FIG. 6). The asymmetric perimeter and recess 25 correspond to each other in order to allow only one way of removably coupling the top member 30 to the body portion 20. This one way of removably coupling the top member 30 to the body portion 20 operates to ensure properly alignment of the valve 50 with the ports 22 in order to properly play the musical instrument.

Figure 8:
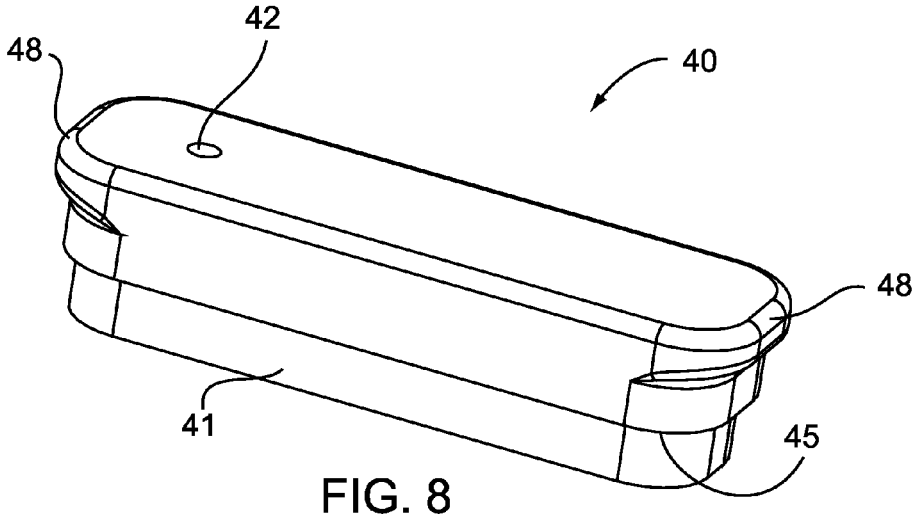
FIG. 8 is a perspective view of a bottom member of a valve case.
Figure 9:
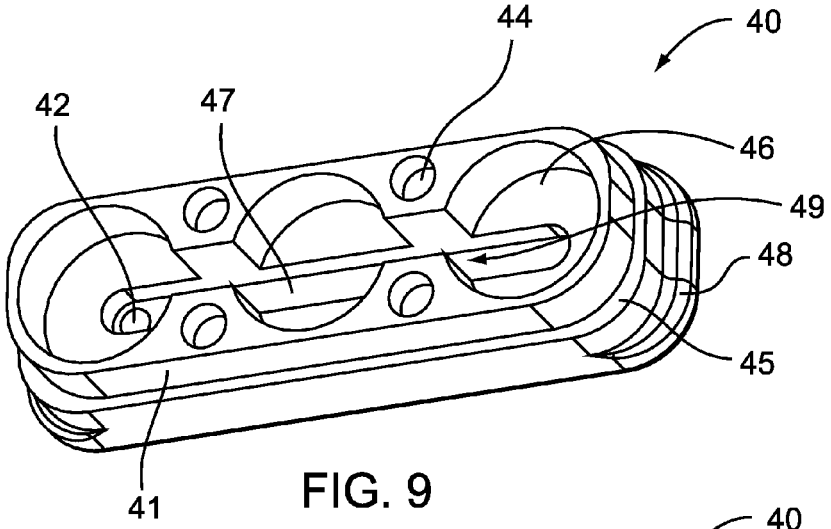
FIG. 9 is another perspective view of a bottom member of a valve case.
Figure 10:
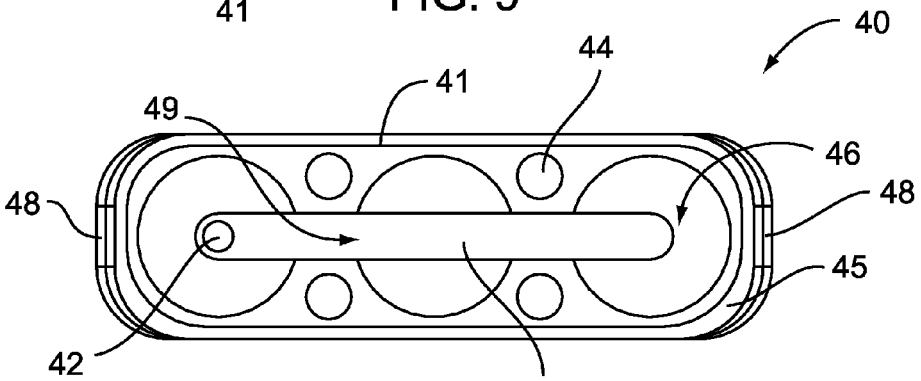
FIG. 10 is a top view of a bottom member of a valve case.

Referring further to the drawings, FIGS. 8-10 depict an embodiment of a bottom member 40 of a valve case 11. The bottom member 40 may be a unitary body that comprises upper portion 41 with one or more chambers 46. The number of chambers 46 corresponds to the number of valves for the musical instrument. For example, as shown, the number of chambers is three; however, it may be four or any other number of chambers. Further, the number of chambers 46 of the bottom member 40 also corresponds to the number of chambers 26 of the main body 20 (see FIG. 7).

The bottom member 40 further includes magnets 44 coupled on a top surface of the upper portion 41 of the bottom member 40. The magnets 44 operate to couple the bottom member 40 to the main body 20. This occurs by magnets 44 engaging magnets 29 of bottom inner surface 62 of the main body 20, wherein the bottom inner surface 62 is formed from recess 60 (see FIG. 7). The bottom member 40 also includes a ridge surface 45, wherein the ridge surface 45 operates to engage a bottom side 23 of the main body 20 (see FIG. 5). The bottom member 40 further includes protrusions 48 extending from opposing sides of the bottom member 40. The protrusions 38 provide a gripping surface for a user to grasp when removing the bottom member 40 from the main body 20.

The bottom member 40 may further include an aperture 42 extending through a bottom surface of the bottom member 40. The aperture 42 functions as a drain for condensation formed within the valve case 11. A spit valve (not shown) may be operatively coupled to the aperture 42 to allow for selective draining of the condensation within the valve case 11. The bottom member 40 further comprises a channel 47 formed in the interior of the bottom member 40, wherein the chambers 46 engage the channel 47. The channel 47 may be slanted or sloped toward the aperture 42. This directs all condensation within the valve case 11 toward the aperture 42 to improve draining of the condensation.

Further, the upper portion 41 of the bottom member 40 may have as asymmetric perimeter. The asymmetric perimeter of the lower portion corresponds to an asymmetric recess 60 extending from a bottom surface 23 of the main body 20 (see FIG. 7). The asymmetric perimeter and recess 60 correspond to each other in order to allow only one way of removably coupling the bottom member 40 to the body portion 20. This one way of removably coupling the bottom member 40 to the body portion 20 operates to ensure properly alignment of the chambers 46 with chamber 26 for proper operation of the valves 50 in order to properly play the musical instrument.

Figure 12:
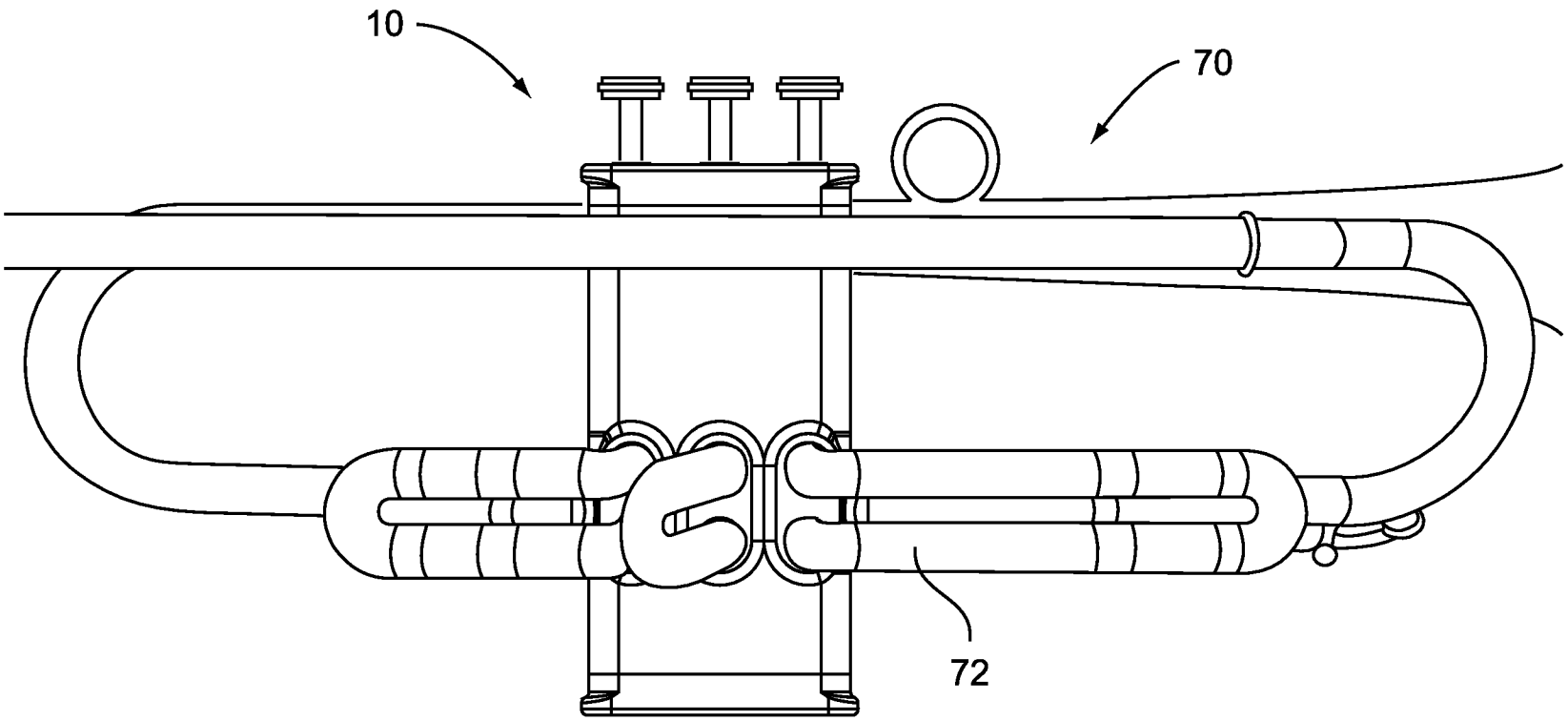
FIG. 12 is a perspective view of a valve system operationally coupled to a musical instrument.
Figure 13:
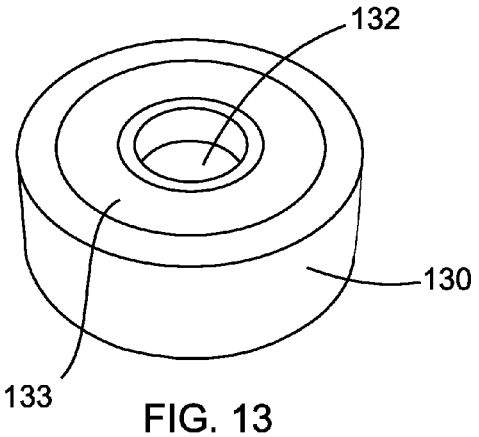
FIG. 13 is a perspective view of a valve cap.
Figure 14:
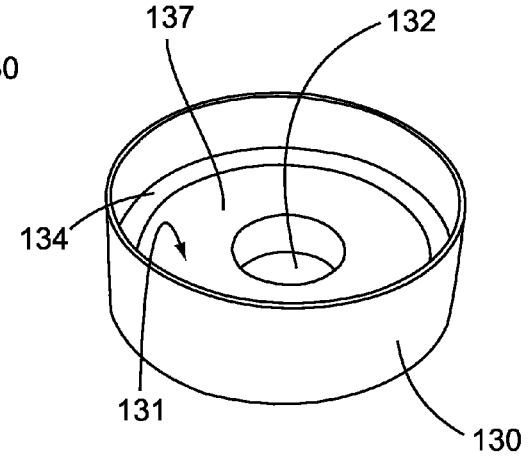
FIG. 14 is a bottom perspective view of a valve cap.
Figure 15:
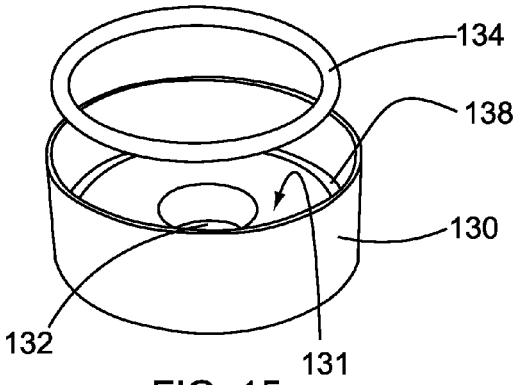
FIG. 15 is a bottom perspective exploded view of a valve cap.
Figure 16:
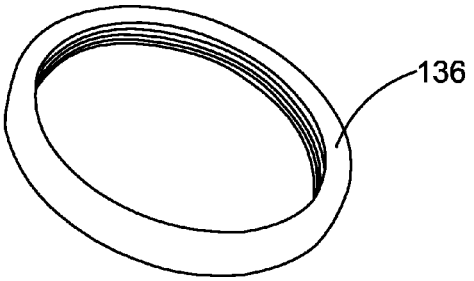
FIG. 16 is a perspective view of an attachment member.
Figure 17:
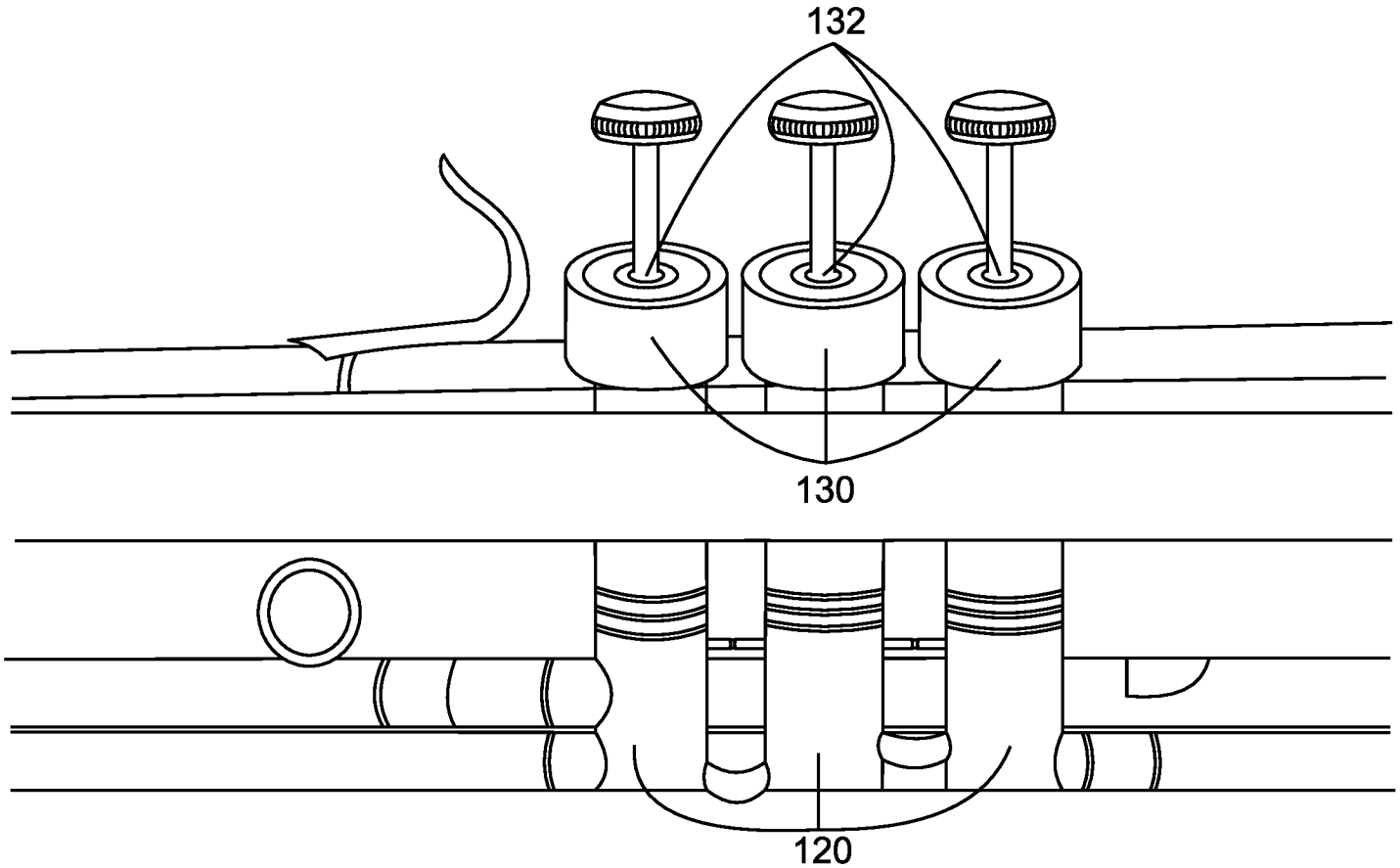
FIG. 17 is a side perspective view of a valve cap attached to a valve casing.
Figure 18:
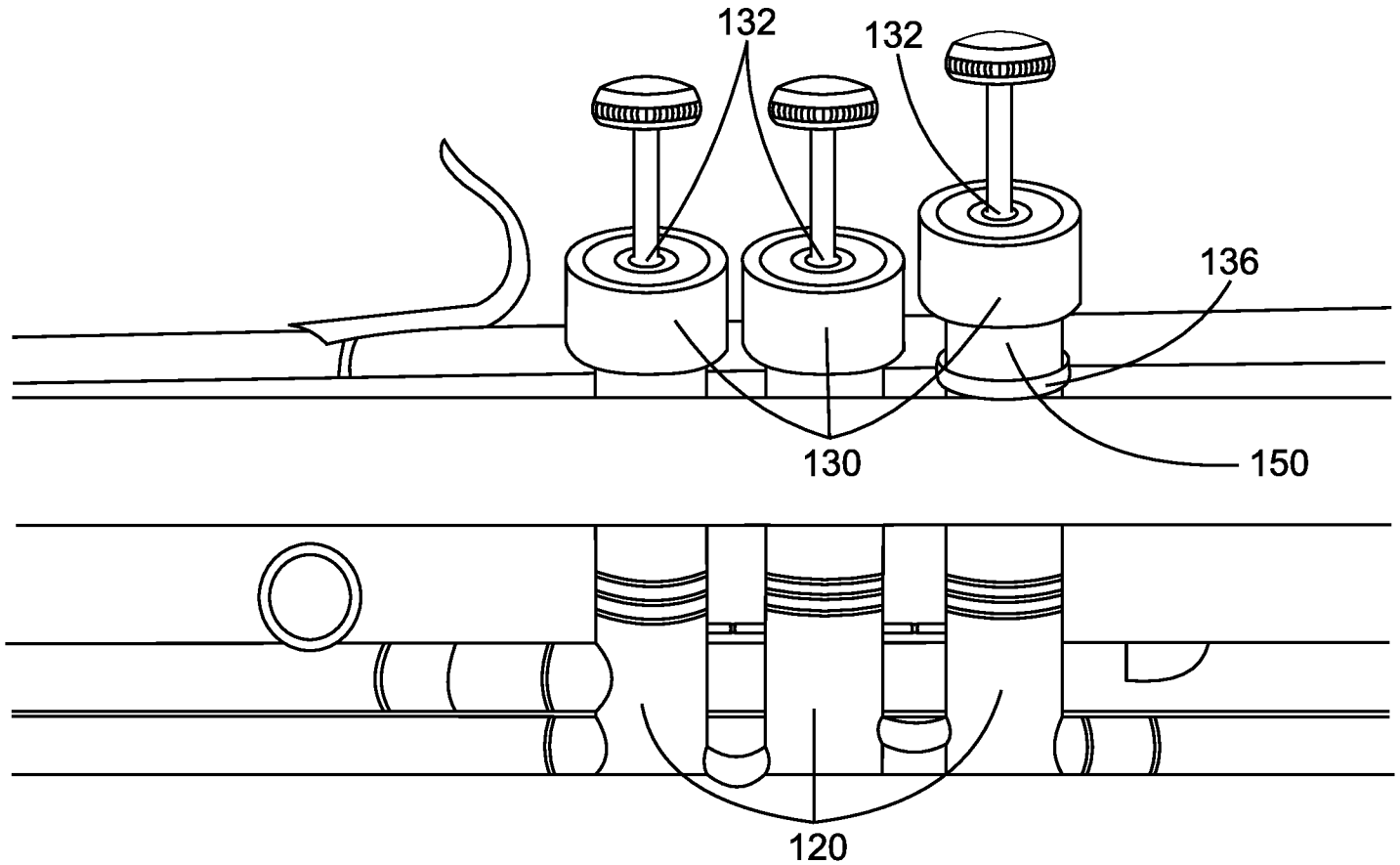
FIG. 18 is a side perspective exploded view of valve caps attached to a valve casings.

Referring to FIG. 12, embodiments of the valve system 10 may be coupled to a musical instrument 70, wherein the musical instrument comprises tubes 72 that couple to the ports 22 of the body portion in order for musical sounds to be produced by the musical instrument through the tubes extending from the mouth piece to the bell. The valve system 10 allows for changing of the pitch by depressing the valves 50. It will be understood that while the musical instrument is shown to be a trumpet, other instruments with valves are contemplated as having a similar valve system 10 coupled to the instrument.

In use, a musician can quickly access the valve system, which operates as a quick release valve system, wherein the top member 30 may be quickly removed from the main body 20 by applying force away from the main body 20 utilized protrusions 38. In the embodiments shown in the drawings figures, removing the top member 30 results in removing all valves 50 from within the chambers 26 of the main body 20. Each valve may have maintenance performed and the top member 30 may then be coupled again to the main body 20. Because of the retaining rod holds the valve in a particular position with regard to the top member 30, the coupling of the top member 30 to the main body 20 results in a self-aligning of the valves 50 with the ports 22. The asymmetric perimeter of the lower portion 31 of the top member 30 further allows for insertion of the lower portion 31 within the recess 25 on the top side 21 of the main body 20 in one direction. This further assists in the self-aligning feature of the valve system.

It will be understood that while it is shown to remove all valves at the same time, other embodiments may employ similar components on a valve by valve basis, wherein each valve includes a main body, a top member and bottom member, with similar attributes to those shown in the drawings figures and discuss herein.

Further, while it is shown that magnets are utilized to removably couple the top member 30 to the main body 20 and the bottom member 40 to the main body 30. It will be understood that in some embodiments, the magnets may be neodymium magnets, however, any magnet may be utilized so long as the attractive force is strong enough to resist separation of the top member 30 form the main body 20 in response to the spring forces applied by the valves 50, wherein the valves 50 include a spring that biases the valve to an open position with the button of the valve extended away from the top member 30. It should also be understood that the present invention is not limited the use of magnets, but may utilize other devices and technology to couple these components together. For example, and without limitation, a ball and plunger, a push button locking device, an over center latch, a tension latch, a Dzus-fastener, an O-Ring, a compression ring, screws and rubber bands.

Referring again to the drawings, FIGS. 13-18 depict a valve cap system 100, wherein the valve cap system 100 comprises a valve cap 130 and an attachment device 135. The valve cap 130 may include a recess 131 on a bottom side of the valve cap 130 and a pad 133 on a top side of the valve cap 130. The recess 131 may include a groove 138 within an inner surface 137. The groove 138 may be sized and shaped to receive a first coupling member 134 of the attachment device 135. The first coupling member 134 may be coupled within the recess 131 of the valve cap 130. In embodiments, the first coupling device 134 is coupled within the groove 138 in the inner surface 137 of the recess 131 of the valve cap 130.

Unlike conventional valve caps, the valve cap 130 of the valve cap system 100 does not include threads and therefore does not couple to a valve casing 120 by use of threads. Rather the attachment device 135 operates to releasably couple the valve cap 130 to the valve casing 120. The attachment device 135 includes the first coupling member 134 coupled to the valve cap 130 and a second coupling member 136 coupled to the valve casing 120. In embodiments, the second coupling member 136 includes inner threads corresponding to the threads of the valve casing 120, wherein the scone coupling member 136 is threadingly coupled to the top of the valve casing 120.

In this position, the second coupling member 136 is in a position to engage the first coupling member 134. In embodiments, the first coupling member 134 and the second coupling member 136 are releasably coupled together with magnetically attractive forces. For example, first coupling member 134 may be a magnet and second coupling member 136 may be formed of a magnetically attractive material. This allows for a magnetically attractive force to engage the first coupling member 134 with the second coupling member 136. In other embodiments, the magnetic force is obtained by the second coupling member 136 being formed of a magnet and the first coupling member 134 being formed of a magnetically attractive material. In further embodiments, the first coupling member 134 and the second coupling members 136 are both formed of magnets, wherein the polarity of the magnets are oriented for proper attraction and to avoid repulsive forces.

As is shown, the attachment device 135 is moveable between a coupled and an uncoupled condition. In the uncoupled condition, the first coupling member 134 is disengaged from the second coupling member 136. In the coupled condition, the first coupling member 134 is engaged with the second coupling member 136. Because of the ease in which the valve cap 130 may be removed from the valve casing 120, the valve cap 130 is a quick release valve cap 130 for easy removal of the valve 150 from within the valve casing 120. In these embodiments, the valve casing is a conventional valve casing when the musical instrument was manufactured. It is also contemplated that aftermarket valve casings may be utilized also.

Figure 19:
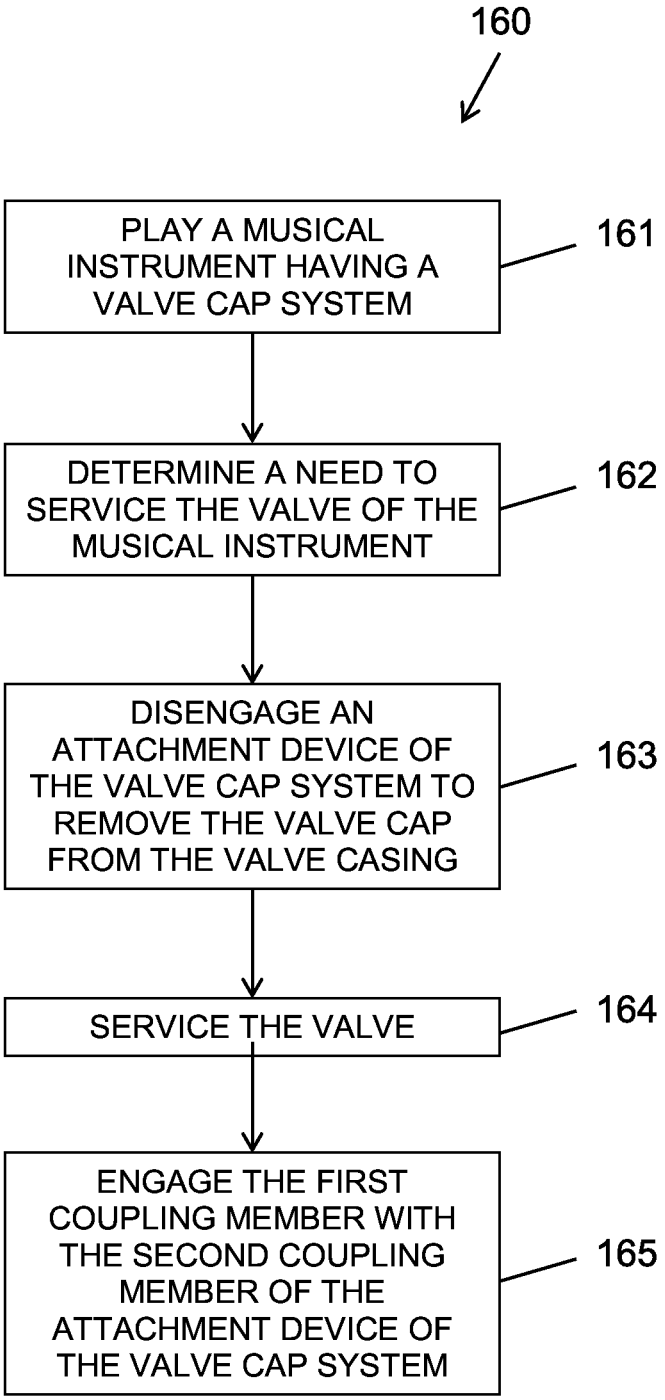
FIG. 19 is a flow chart of a method of using a valve cap system.

Referring to FIG. 19, a method 160 of using a valve cap system is shown. The method 160 may include playing a musical instrument having a valve cap system (Step 161) having a valve cap comprising an aperture for a stem of a valve to extend there through and a recess for receiving a valve casing within the recess; determining a need to service the valve of the musical instrument (Step 162); disengaging an attachment device of the valve cap system to remove the valve cap from the valve casing (Step 163); servicing the valve (Step 164); and engaging the first coupling member with the second coupling member of the attachment device of the valve cap system (Step 165).

The method 160 may further comprise applying force on the valve cap in a direction of the finger pad of the valve to disengage the attachment device, wherein the force exceeds the magnetically attractive force between the first coupling member and the second coupling member.

Accordingly, the components defining any musical instrument valve system may be formed of any of many different types of materials or combinations thereof that can readily be formed into shaped objects provided that the components selected are consistent with the intended operation of a musical instrument valve system. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any musical instrument valve system may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A musical instrument valve cap system comprising:

a valve cap comprising an aperture for a stem of a valve to extend there through and a recess for receiving a valve casing within the recess; and an attachment device for releasably coupling the valve cap to a valve casing, wherein the attachment device comprises:

a first coupling member coupled within the recess of the valve cap; and a second coupling member coupled to a top end of the valve casing, wherein the first coupling member is releasably coupled to the second coupling member without threads.

2. The valve cap system of claim 1, wherein the first coupling member and the second coupling member are releasably coupled together through magnetically attractive forces.

3. The valve cap system of claim 1, wherein the second coupling member is threadingly coupled to the valve casing using existing threads of the valve casing.

4. The valve cap system of claim 1, wherein the attachment device is moveable between a coupled and an uncoupled condition.

5. The valve cap system of claim 4, wherein in the uncoupled condition, the first coupling member is disengaged from the second coupling member of the attachment device.

6. The valve cap system of claim 4, wherein in the coupled condition, the first coupling member is engaged with the second coupling member of the attachment device.

7. The valve cap system of claim 1, wherein the first coupling member is coupled within a groove located on an inner surface of the recess of the valve cap.

8. The valve cap system of claim 1, wherein the valve cap is a quick release valve cap for easy removal of the valve from within the valve casing.

9. The valve cap system of claim 1, wherein the valve casing is a conventional valve casing when the musical instrument was manufactured.

10. A method of using a musical instrument valve cap system, the method comprising:

playing a musical instrument having a valve cap comprising an aperture for a stem of a valve to extend there through and a recess for receiving a valve casing within the recess;

determining a need to service the valve of the musical instrument;

disengaging an attachment device of the valve cap system to remove the valve cap from the valve casing, wherein the attachment device comprises:

a first coupling member coupled to the valve cap; and a second coupling member coupled to a top end of the valve casing, wherein the first coupling member is releasably coupled to the second coupling member without threads;

servicing the valve; and engaging the first coupling member with the second coupling member of the attachment device of the valve cap system.

11. The method of claim 10, wherein the first coupling member and the second coupling member are releasably coupled together through magnetically attractive forces.

12. The method of claim 11, further comprising applying force on the valve cap in a direction of a finger pad of the valve to disengage the attachment device, wherein the force exceeds the magnetically attractive force between the first coupling member and the second coupling member.

13. The method of claim 10, wherein the second coupling member is threadingly coupled to the valve casing using existing threads of the valve casing.

14. The method of claim 10, wherein the attachment device is moveable between a coupled and an uncoupled condition.

15. The method of claim 14, wherein in the uncoupled condition, the first coupling member is disengaged from the second coupling member of the attachment device.

16. The method of claim 15, wherein in the coupled condition, the first coupling member is engaged with the second coupling member of the attachment device.

17. The valve cap system of claim 10, wherein the first coupling member is coupled within a groove located on an inner surface of the recess of the valve cap.

18. A musical instrument valve system comprising:

a main body comprising an inner chamber and a port;

a top member comprising a chamber corresponding to the inner chamber of the main body, wherein the top member is removably coupled to a top side of the main body;

a bottom member comprising a chamber corresponding to the inner chamber of the main body, wherein the bottom member is removably coupled to a bottom side of the main body; and more than one valve operatively coupled to the top member, wherein the more than one valve is removed from the main body in response to removing the top member.

19. The valve system of claim 18, wherein the top member is removably coupled to the main body by magnetic forces.

20. The valve system of claim 18, wherein:

the main body comprises more than one inner chamber and port;

the top member comprises more than one chamber corresponding to the more than one inner chamber of the main body, wherein the top member is removably coupled to a top side of the main body; and the bottom member comprises more than one chamber corresponding to the more than one inner chamber of the main body, wherein the bottom member is removably coupled to a bottom side of the main body.

* * * * *